US009449771B1

(12) United States Patent
Chen

(10) Patent No.: US 9,449,771 B1
(45) Date of Patent: Sep. 20, 2016

(54) KEYBOARD MODULE

(71) Applicant: Primax Electronics Ltd., Neihu, Taipei (TW)

(72) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 14/723,084

(22) Filed: May 27, 2015

(30) Foreign Application Priority Data

Apr. 2, 2015 (TW) ..... 104110931 A

(51) Int. Cl.
*H01H 9/26* (2006.01)
*H01H 13/704* (2006.01)
*H01H 13/7065* (2006.01)
*H01H 13/703* (2006.01)

(52) U.S. Cl.
CPC ..... *H01H 13/704* (2013.01); *H01H 13/703* (2013.01); *H01H 13/7065* (2013.01); *H01H 2209/002* (2013.01); *H01H 2209/024* (2013.01); *H01H 2209/046* (2013.01); *H01H 2217/01* (2013.01); *H01H 2227/036* (2013.01)

(58) Field of Classification Search
CPC ..... H01H 13/704; H01H 13/7065; H01H 2209/002; H01H 2209/024; H01H 2209/046; H01H 2217/01; H01H 2227/036
USPC ..... 200/5 A, 310–314, 512, 517, 344–345
See application file for complete search history.

(56) References Cited

U.S. PATENT DOCUMENTS 8,431,843 B2 * 4/2013 Chen ..... H01H 13/79 200/5 A
2006/0283698 A1 * 12/2006 Huang ..... G06F 3/0202 200/310
2012/0298496 A1 * 11/2012 Zhang ..... H01H 3/125 200/5 A
2015/0014136 A1 * 1/2015 Liang ..... H01H 13/83 200/5 A
2015/0129406 A1 * 5/2015 Zhang ..... H01H 13/705 200/5 A

* cited by examiner

*Primary Examiner* — Edwin A. Leon
(74) *Attorney, Agent, or Firm* — Kirton McConkie; Evan R. Witt

(57) ABSTRACT

A keyboard module includes a pressing layer, a switch circuit board, a base plate and plural glue dots. The pressing layer includes plural key parts. The switch circuit board includes plural first wiring patterns, plural second wiring patterns and plural spacing dots. The plural glue dots are disposed on a lower wiring plate of the switch circuit board. The plural glue dots and the plural spacing dots are staggered. Due to the plural glue dot, the non-bonding zones of the lower wiring plate without the glue dots are bendable. When the key part is pressed, the lower wiring plate corresponding to the pressed key part is bent. Consequently, the first wiring pattern is inserted into the region between the corresponding spacing dots and contacted with the corresponding second wiring pattern.

10 Claims, 9 Drawing Sheets

KEYBOARD MODULE

FIELD OF THE INVENTION

The present invention relates to a keyboard module, and more particularly to a slim-type keyboard module.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay attention to the development of keyboard devices. The keyboard devices are classified into two types, i.e. the keyboard devices for desktop computers and the keyboard modules for notebook computers.

FIG. 1 is a schematic top view illustrating the outer appearance of a conventional keyboard module. As shown in FIG. 1, plural keys 10 are formed on a surface of the conventional keyboard module 1. These keys 10 are classified into several types, e.g. ordinary keys 101, numeric keys 102 and function keys 103. When one of these keys 10 is pressed by the user's finger, a corresponding signal is issued to the computer, and thus the computer executes a function corresponding to the pressed key. For example, when an ordinary key 101 is pressed, a corresponding English letter or symbol is inputted into the computer. When a numeric key 102 is pressed, a corresponding number is inputted into the computer. In addition, the function keys 103 (F1~F12) can be programmed to provide various functions. The conventional keyboard module 1 is a keyboard device for a notebook computer.

Hereinafter, the inner structure of a conventional keyboard module will be illustrated in more details. FIG. 2 is a schematic cross-sectional view illustrating a conventional keyboard module. As shown in FIG. 2, the conventional keyboard module 2 comprises plural keys 20, a membrane switch circuit member 21 and a base plate 22. Each key 20 comprises a keycap 201, a scissors-type connecting element 202 and an elastic element 203. From top to bottom, the keycap 201, the scissors-type connecting element 202, the elastic element 203, the membrane switch circuit member 21 and the base plate 22 of the conventional keyboard module 2 are sequentially shown. The base plate 22 is used for supporting the keycaps 201, the scissors-type connecting elements 202, the elastic elements 203 and the membrane switch circuit member 21. For supporting these components, the base plate 22 is preferably made of a metallic material in order to provide the stronger structural strength. The conventional keyboard module 2 is a keyboard device for a notebook computer (not shown).

In the key 20, the keycap 201 is exposed outside the conventional luminous keyboard module 2, so that the keycap 201 can be pressed by the user. The scissors-type connecting element 202 is used for connecting the keycap 201 and the base plate 22. The elastic element 203 is penetrated through the scissors-type connecting element 202. In addition, both ends of the elastic element 203 are contacted with the keycap 201 and the membrane switch circuit member 21, respectively. The membrane switch circuit member 21 comprises an upper wiring plate 211, a spacer layer 212, and a lower wiring plate 213. The upper wiring plate 211 has plural upper contacts 2111. The spacer layer 212 is disposed under the upper wiring plate 211, and comprises plural perforations 2121 corresponding to the plural upper contacts 2111. The lower wiring plate 213 is disposed under the spacer layer 212, and comprises plural lower contacts 2131 corresponding to the plural upper contacts 2111. The plural lower contacts 2131 and the plural upper contacts 2111 are collectively defined as plural key switches 214. While the keycap 201 is pressed by the user, the keycap 201 is moved downwardly to push the elastic element 203 and trigger the corresponding key switch 214. During the triggering process, the movable distance of the keycap 201 in the downward direction is defined as a travelling distance.

Recently, the general trends in designing electronic devices (e.g., notebook computers or tablet computers) are toward slimness and light weightiness, and thus the conventional keyboard module needs to meet the requirements of slimness. For achieving this purpose, the manufacturers of the keyboard modules make efforts in minimizing the thickness of the keyboard modules. In accordance with the conventional approach, the thicknesses of the components of the keyboard module should be as small as possible. Nowadays, a keyboard module without the travelling distance was introduced into the market. The keyboard module is not equipped with the keycaps 201, the scissors-type connecting elements 202 and the elastic elements 203 as shown in FIG. 2. On the other hand, this keyboard module is equipped with a pressing layer in replace of the conventional keys 20. The pressing layer is a thin plastic film with plural key parts corresponding to the locations of the keycaps 201 as shown in FIG. 2. Moreover, symbols, letters or numbers are printed on the corresponding key parts. When one of the key parts is pressed, the membrane switch circuit member under the pressed key part is triggered to generate the corresponding key signal. In addition, the key part is subjected to slight deformation and not moved. Consequently, this keyboard module may be referred as the keyboard module without the travelling distance.

However, since the membrane switch circuit member only has a key switch corresponding to one key part. Since the key switch is located at a middle region of the key part, the user has to press the middle region of the key part in order to trigger the corresponding key switch. If the middle region of the key part is not pressed, the key signal is not generated. In other words, the conventional keyboard module is not user-friendly.

Therefore, there is a need of providing an improved slim-type keyboard module in order to overcome the above drawbacks.

SUMMARY OF THE INVENTION

An object of the present invention provides a slim-type keyboard module. For generating a key signal, the pressed position of a key part is not restricted to the middle region.

In accordance with an aspect of the present invention, there is provided a keyboard module. The keyboard module includes a pressing layer, a switch circuit board, a base plate and plural glue dots. The pressing layer includes plural key parts. The plural key parts are exposed to a top surface of the keyboard module. The switch circuit board is disposed under the pressing layer. When the switch circuit board is triggered by one of the plural key parts, a corresponding key signal is generated. The switch circuit board includes plural key intersections and plural spacing dots. The base plate is connected with the switch circuit board. The pressing layer and the switch circuit board are supported on the base plate. The plural glue dots are arranged between the base plate and the switch circuit board. The base plate and the switch circuit board are combined together through the plural glue dots. The plural glue dots and the plural spacing dots are staggered.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For eliminating the drawbacks of the conventional technologies, the present invention provides a keyboard module.

Figure 1:
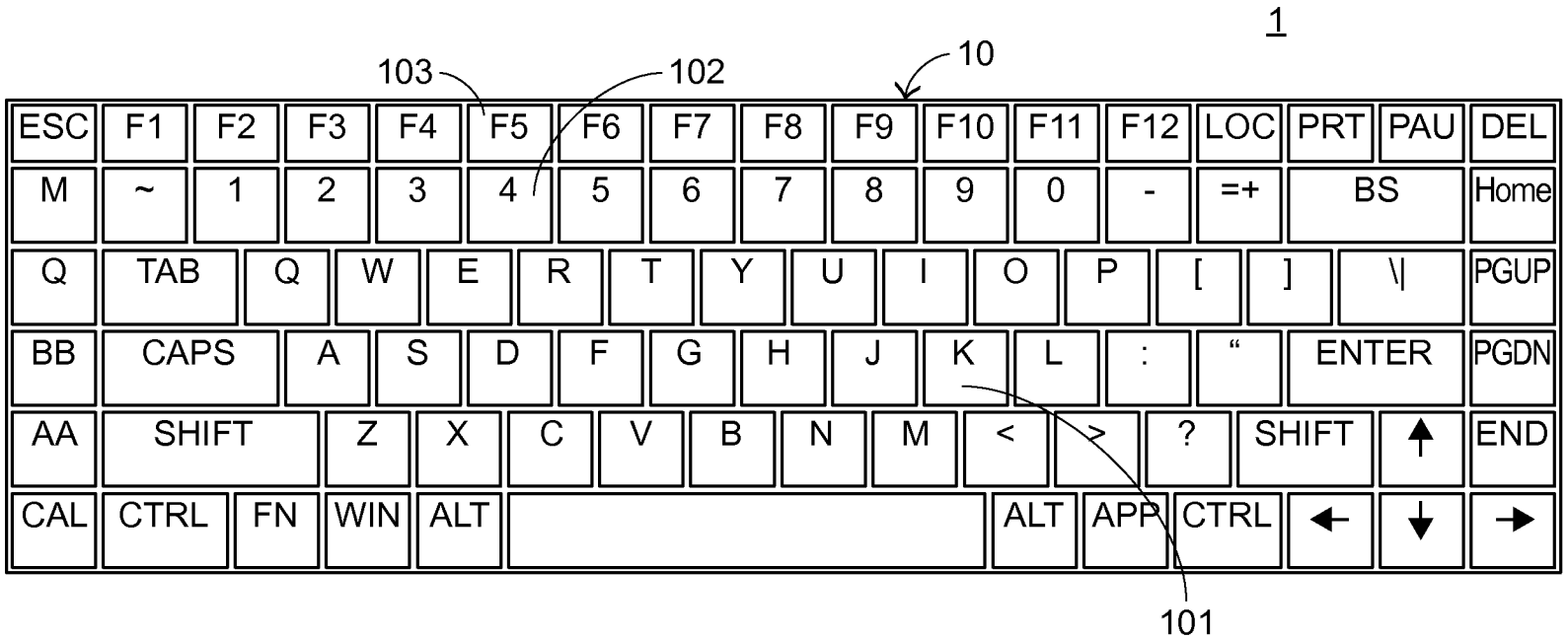
FIG.1 PRIOR ART
FIG. 1 is a schematic top view illustrating the outer appearance of a conventional keyboard module.
Figure 2:
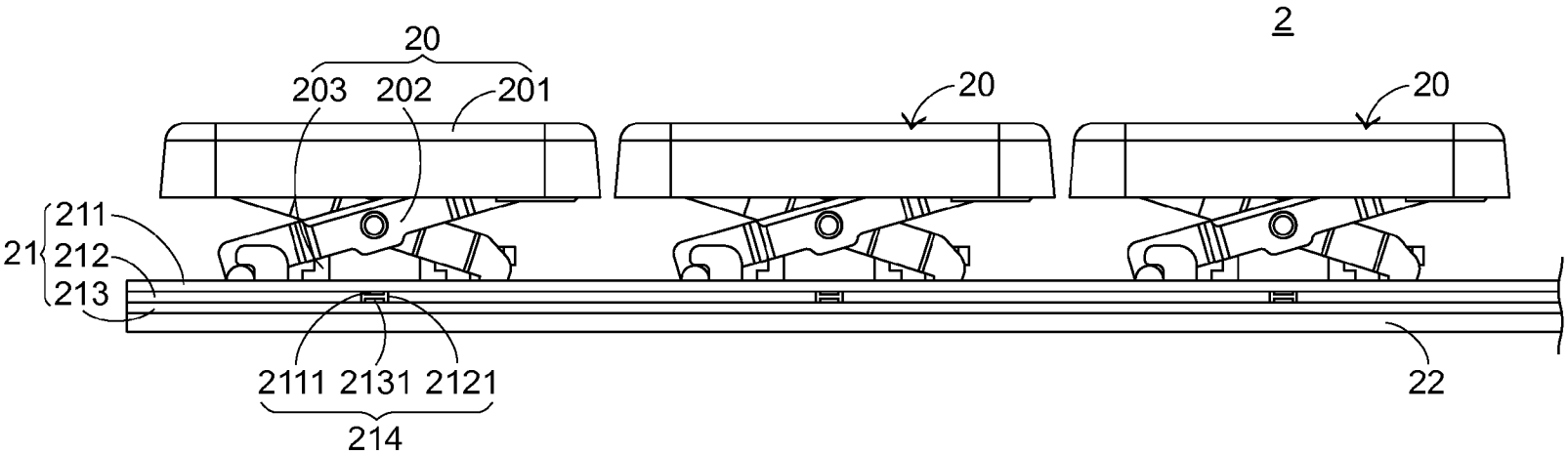
FIG.2 PRIOR ART
FIG. 2 is a schematic cross-sectional view illustrating a conventional keyboard module.
Figure 3:
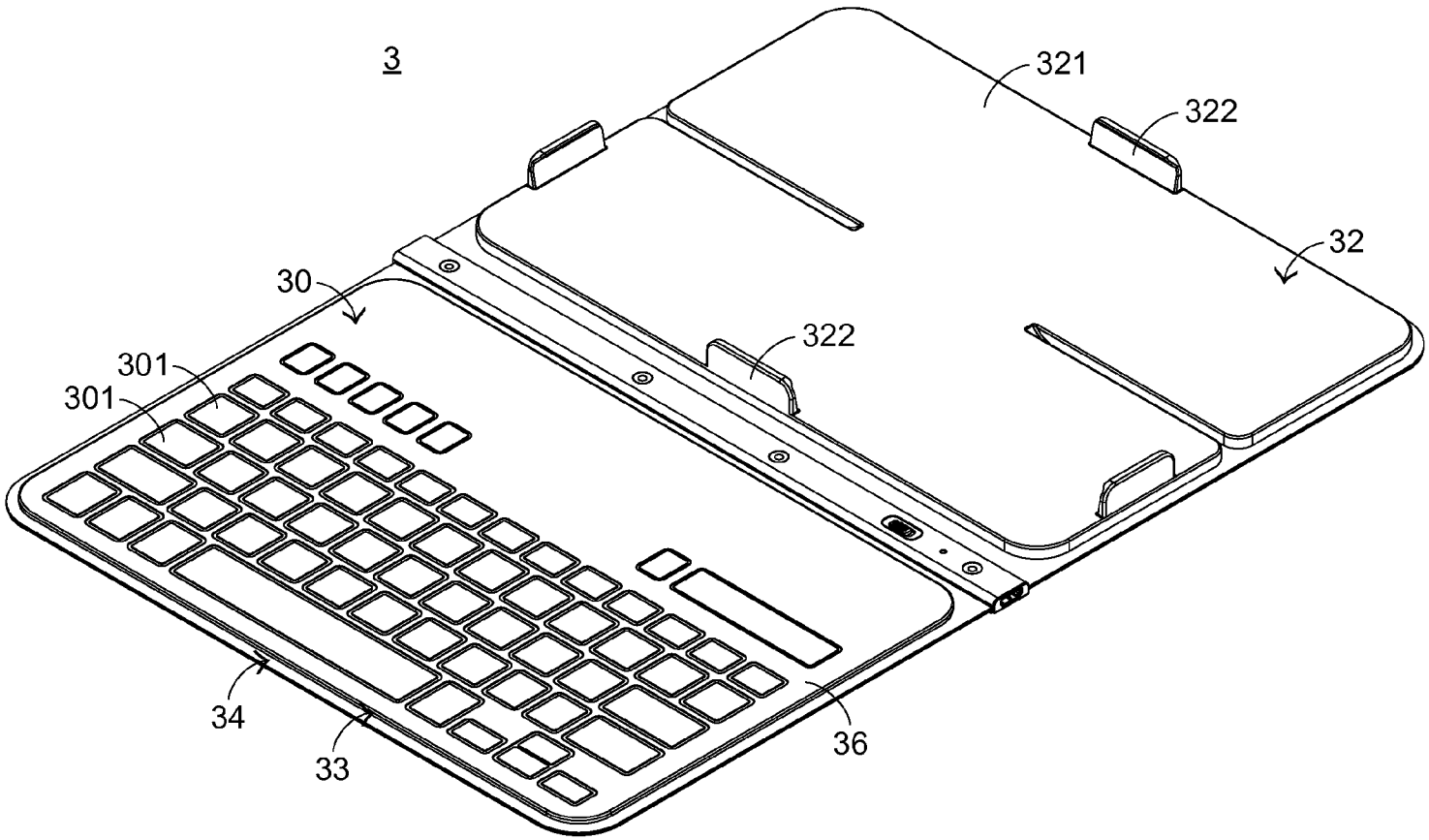
FIG. 3 is a schematic perspective view illustrating a keyboard module according to a first embodiment of the present invention.
Figure 4:
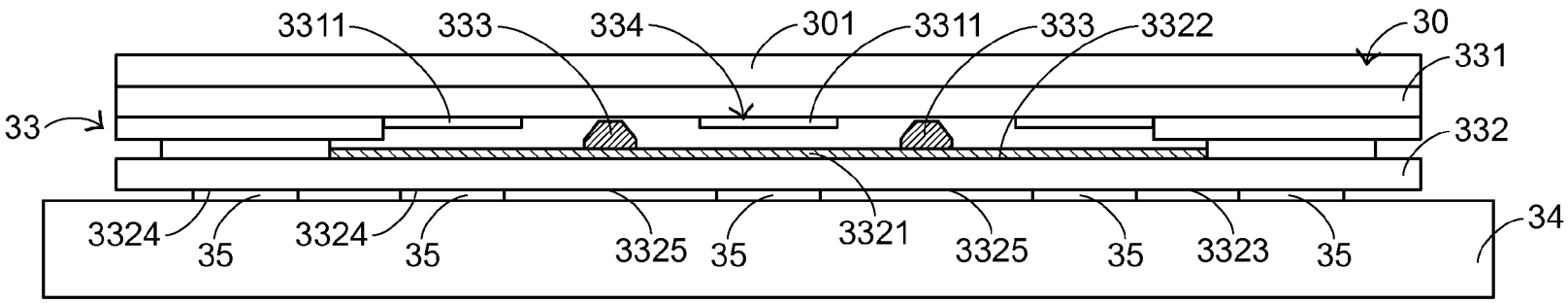
FIG. 4 is a schematic cross-sectional view illustrating the keyboard module according to the first embodiment of the present invention.

FIG. 3 is a schematic perspective view illustrating a keyboard module according to a first embodiment of the present invention. FIG. 4 is a schematic cross-sectional view illustrating the keyboard module according to the first embodiment of the present invention. Please refer to FIGS. 3 and 4. The keyboard module 3 comprises a pressing layer 30, a covering member 32, a switch circuit board 33, a base plate 34 and plural glue dots 35. The pressing layer 30 comprises plural key parts 301. The plural key parts 301 are exposed to a top surface 36 of the keyboard module 3. When the pressing layer 30 is pressed by the user, the pressing layer 30 is subjected to slight deformation to trigger the switch circuit board 33. The base plate 34 is connected with the switch circuit board 33. The pressing layer 30 and the switch circuit board 33 are supported on the base plate 34. The covering member 32 is connected with the base plate 34. Moreover, the covering member 32 is rotatable relative to the base plate 34. Consequently, the covering member 32 is selectively in a close state to cover the top surface 36 of the keyboard module 3 or in an open state to expose the keyboard module 3 (see FIG. 3). Moreover, the covering member 32 comprises an accommodation space 321 and plural fixing structures 322. An electronic device (not shown) can be accommodated within the accommodation space 321. The plural fixing structures 322 can fix the electronic device within the accommodation space 321.

In an embodiment, the pressing layer 30 is made of polyurethane (PU), the base plate 34 is made of fiberglass reinforced epoxy resin (e.g., Flame Retardant Type 4, FR4), the electronic device is a tablet computer, and the electronic device is locked in the accommodation space 321 through the plural fixing structures 322. Preferably but not exclusively, the keyboard module 3 is a keyboard device for a tablet computer. In some other embodiments, the keyboard module is not equipped with the covering member. Under this circumstance, the keyboard module only has the keyboard function but does not have the function of accommodating the electronic device.

Figure 5:
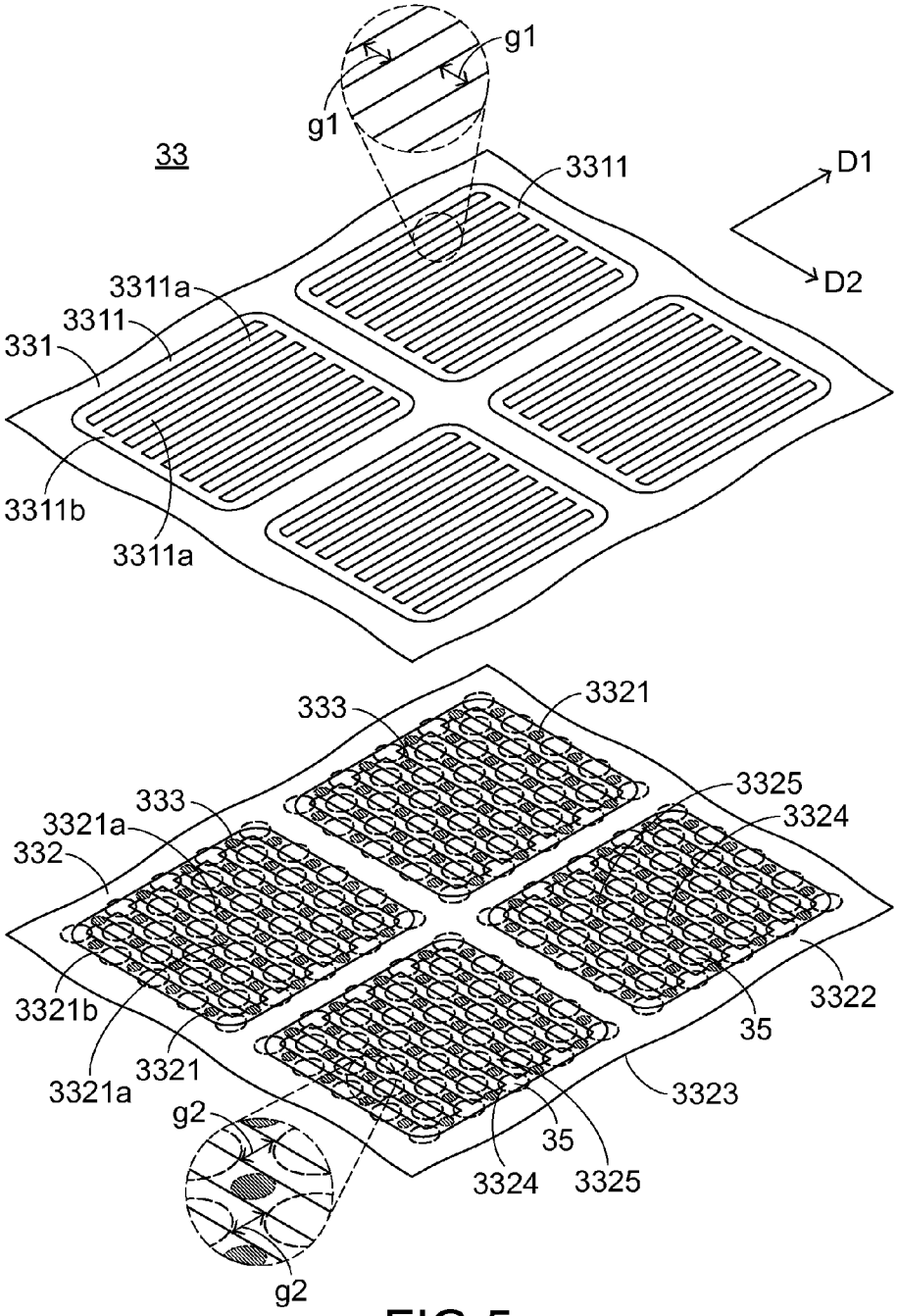
FIG. 5 is a schematic exploded view illustrating the switch circuit board of the keyboard module according to the first embodiment of the present invention.

FIG. 5 is a schematic exploded view illustrating the switch circuit board of the keyboard module according to the first embodiment of the present invention. Please refer to FIGS. 3, 4 and 5. The switch circuit board 33 is disposed under the pressing layer 30. When the switch circuit board 33 is triggered by one of the plural key parts, a corresponding key signal is generated. In this embodiment, the switch circuit board 33 comprises an upper wiring plate 331, a lower wiring plate 332, plural spacing dots 333 and plural key intersections 334. The upper wiring plate 331 comprises plural first wiring patterns 3311. Each of the first wiring patterns 3311 comprises plural first inner wiring parts 3311*a* and a first outer wiring part 3311*b* around the plural first inner wiring parts 3311*a*. The lower wiring plate 332 is disposed under the upper wiring plate 331. Similarly, the lower wiring plate 332 comprises plural second wiring patterns 3321. Each of the second wiring patterns 3321 comprises plural second inner wiring parts 3321*a* and a second outer wiring part 3321*b* around the plural second inner wiring parts 3321*a*. As shown in FIG. 5, the plural first inner wiring parts 3311*a* are arranged along a vertical direction D1, and the plural second inner wiring parts 3321*a* are arranged along a horizontal direction D2. Each first wiring pattern 3311 and the corresponding second wiring pattern 3321 are aligned with the corresponding key part 301.

As shown in FIGS. 4 and 5, the plural spacing dots 333 are arranged between the upper wiring plate 331 and the lower wiring plate 332. The upper wiring plate 331 and the lower wiring plate 332 are separated from each other by the plural spacing dots 333. The overlap regions between the first inner wiring parts 3311*a* of the first wiring patterns 3311 and the second inner wiring parts 3321*a* of the second wiring patterns 3321 are formed as the corresponding key intersections 334. Each key intersection 334 is correlated with plural nearby spacing dots 333. That is, one spacing dot 333 is shared by plural key intersections 334. When the key part 301 is pressed, the key part 301 is subjected to deformation to trigger the switch circuit board 33. Correspondingly, the upper wiring plate 331 is bent downwardly. Meanwhile, the first wiring pattern 3311 of the corresponding key intersection 334 is inserted into the region between the corresponding spacing dots 333 so as to be electrically contacted with the corresponding second wiring pattern 3321. As a consequence, the corresponding key signal is generated. In other words, the action of pressing the key part 301 can achieve the similar purpose of pressing the key of the conventional keyboard device.

Moreover, every two adjacent first inner wiring parts 3311*a* are separated from each other by a first gap g1, and every two adjacent second inner wiring parts 3321*a* are separated from each other by a second gap g2. The widths of the first gaps g1 are identical. The widths of the second gaps g2 are identical. More preferable, the width of the first gap g1 and the width of the second gap g2 are identical. Due to the identical structures of these gaps, the hand feel of pressing the key part 301 will be enhanced.

The plural glue dots 35 are arranged between the base plate 34 and the lower wiring plate 332 of the switch circuit board 33. The base plate 34 and the switch circuit board 33 are combined together through the plural glue dots 35. The plural glue dots 35 and the plural spacing dots 333 are staggered and not overlapped. In an embodiment, each of the upper wiring plate 331 and the lower wiring plate 332 is made of polyethylene terephthalate (PET), polyurethane (PU), polyimide (PI) or polypropylene (PP). Preferably, the plural spacing dots 333 are formed on a top surface 3322 of the lower wiring plate 332 by a printing process. In some other embodiments, the plural spacing dots are formed on a bottom surface of the upper wiring plate by a spraying process, a transfer printing process or a coating process.

Figure 6:
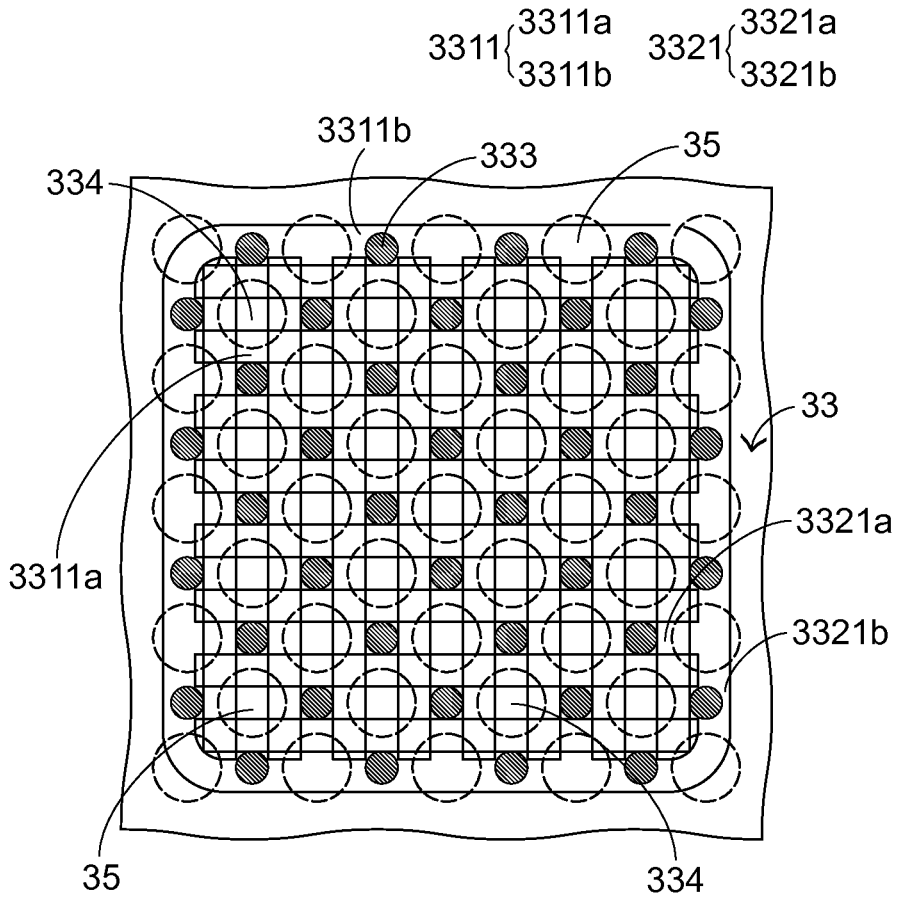
FIG. 6 is a schematic assembled view illustrating a portion of the switch circuit board of FIG. 5.

FIG. 6 is a schematic assembled view illustrating a portion of the switch circuit board of FIG. 5. Please refer to FIGS. 3, 4, 5 and 6. In FIG. 6, a portion of the switch circuit board 33 is shown. In this embodiment, all of the spacing dots 333 are disposed on the second wiring pattern 3321. That is, the other spacing dots 333 and the plural key intersections 334 are staggered. A bottom surface 3323 of the lower wiring plate 332 comprises plural bonding zones 3324 and plural non-bonding zones 3325. The plural bonding zones 3324 are the regions of the bottom surface 3323 of the lower wiring plate 332 where the plural glue dots 35 are located. That is, the plural glue dots 35 are disposed on the corresponding bonding zones 3324. Through the plural glue dots 35 on the bonding zones 3324, the lower wiring plate 332 is fixed on the base plate 34. On the other hand, the plural non-bonding zones 3325 are the regions of the bottom surface 3323 of the lower wiring plate 332 where no glue dots 35 are included.

In this embodiment, the plural glue dots 35 are aligned with the corresponding key intersections 334. That is, the key intersections 334 of the lower wiring plate 332 are all fixed on the base plate 34 through the plural glue dots 35. Moreover, the plural spacing dots 333 disposed on the lower wiring plate 332 corresponding non-bonding zones 3325.

Figure 7:
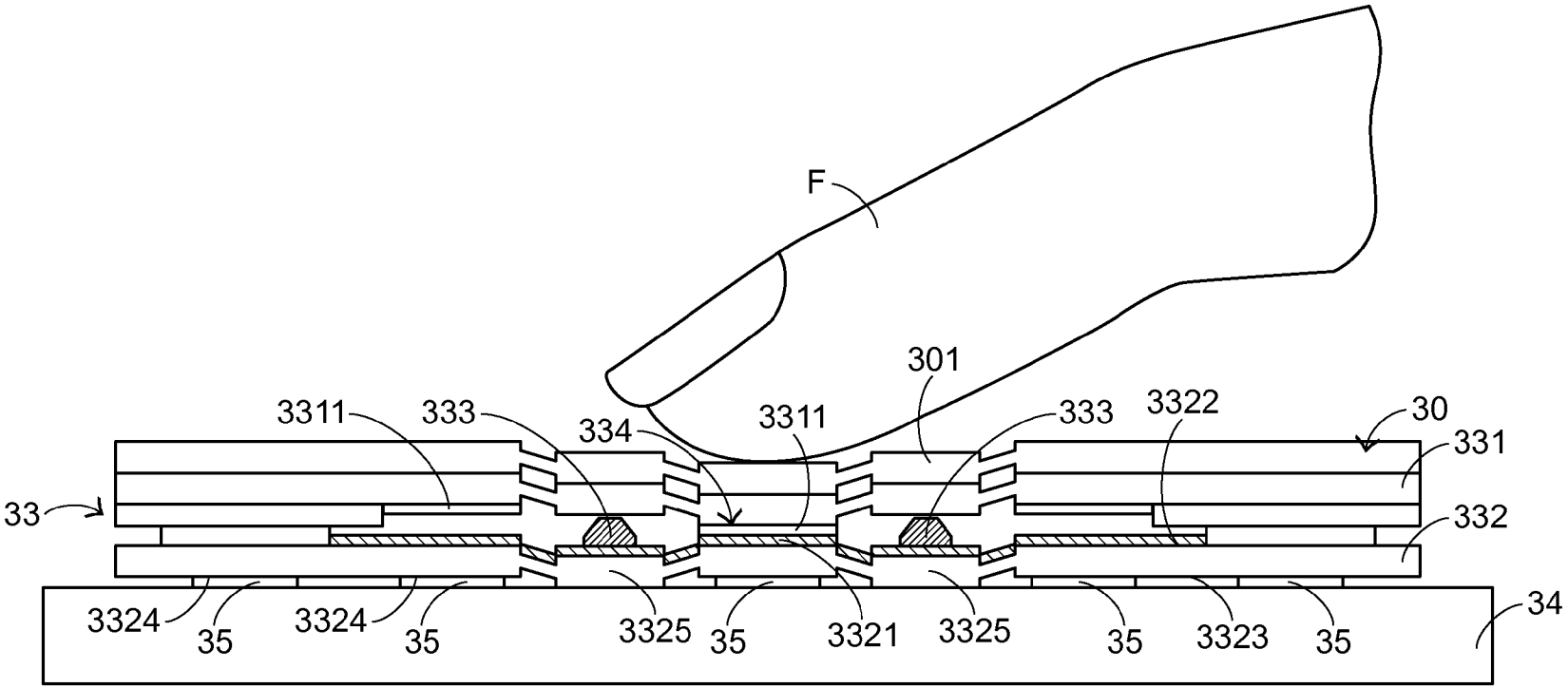
FIG. 7 is a schematic cross-sectional view illustrating a portion of the keyboard module according to the first embodiment of the present invention, in which one key part is pressed.

The reason why the plural glue dots 35 are aligned with the corresponding key intersections 334 will be illustrated as follows. FIG. 7 is a schematic cross-sectional view illustrating a portion of the keyboard module according to the first embodiment of the present invention, in which one key part is pressed. In this embodiment, the plural spacing dots 333 are disposed on the top surface 3322 of the lower wiring plate 332. Owing to a production error, the heights of the plural spacing dots 333 are somewhat different. Under this circumstance, the hand feel of pressing the key part 301 is possibly impaired. Moreover, even if the pressed first wiring pattern 3311 is inserted into the region between the corresponding spacing dots 333, the pressed first wiring pattern 3311 cannot be contacted with the corresponding second wiring pattern 3321 and the key signal cannot be generated. For solving these drawbacks, a part of the lower wiring plate 332 corresponding to the plural bonding zones 3324 is fixed on the base plate 34, and the other part of the lower wiring plate 332 corresponding to the plural non-bonding zones 3325 are not fixed on the base plate 34. When one of the key parts 301 is pressed by the user's finger F to push the switch circuit board 33, the upper wiring plate 331 is bent, and the non-bonding zones 3325 corresponding to the pressed key part 301 is moved. Consequently, the lower wiring plate 332 corresponding to the non-bonding zones 3325 is bent in the direction toward the base plate 34 (i.e., bent downwardly). In addition, the pressed first wiring pattern 3311 corresponding to the key intersection 334 is inserted into the region between the corresponding spacing dots 333. Since the lower wiring plate 332 is bent downwardly, the portion of the second wiring pattern 3321 corresponding to the pressed first wiring pattern 3311 is located at a level higher than the portion of the second wiring pattern 3321 corresponding to the bent lower wiring plate 332. Under this circumstance, the pressed first wiring pattern 3311 and the corresponding second wiring pattern 3321 can be electrically contacted with each other to generate the corresponding key signal.

In other words, the plural bonding zones 3324 of the lower wiring plate 332 are used as support points. When the key part 301 is pressed and the corresponding lower wiring plate 332 is bent, the first wiring pattern 3311 and the corresponding second wiring pattern 3321 can be electrically contacted with each other. That is, when the key part 301 is pressed, the key signal can be correspondingly generated.

The following two aspects should be specially described. Firstly, in comparison with the conventional keyboard module, the keyboard module is not equipped with keycaps, scissors-type connecting elements and elastic elements. Since the first wiring pattern 3311 and the second wiring pattern 3321 corresponding to each key part 301 contain plural key intersections 334 and the plural key intersections 334 are distributed within the second inner wiring part 3321*a*, the pressed position of the key part 301 is not restricted to the middle region thereof. In other words, when any position of the key part 301 is pressed by the user's finger F, at least one corresponding key intersection 334 is triggered to generate the corresponding key signal. Secondly, as shown in FIGS. 5 and 6, the plural spacing dots 333 are uniformly distributed on the lower wiring plate 332 corresponding to the key part 301 and the distances between the four corners of the key part 301 and the corresponding spacing dots 333 are identical. Consequently, even if one of the four corners of the key part 301 is pressed, a corresponding key signal can be effectively generated.

Figure 8:
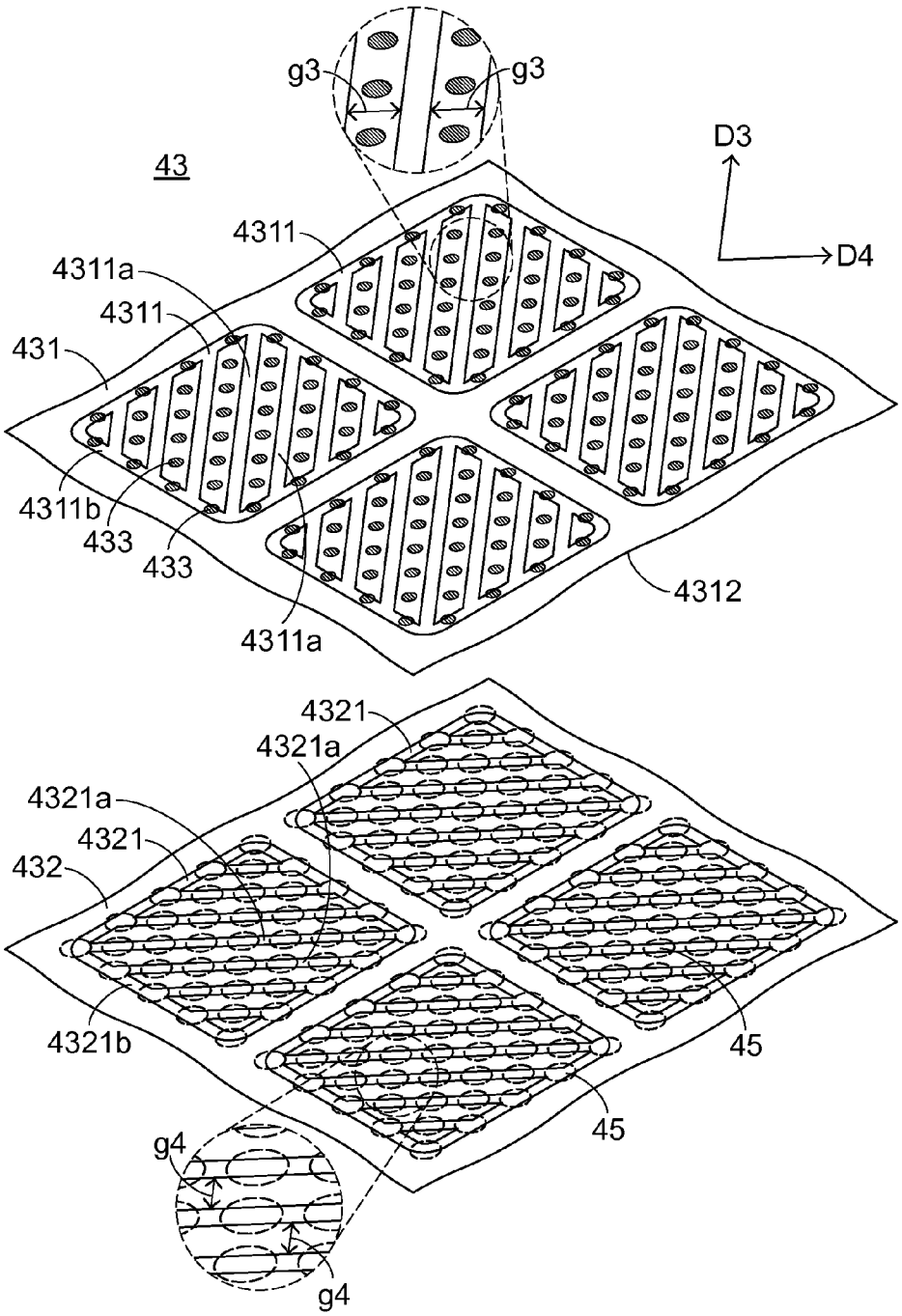
FIG. 8 is a schematic exploded view illustrating a switch circuit board of a keyboard module according to a second embodiment of the present invention.
Figure 9:
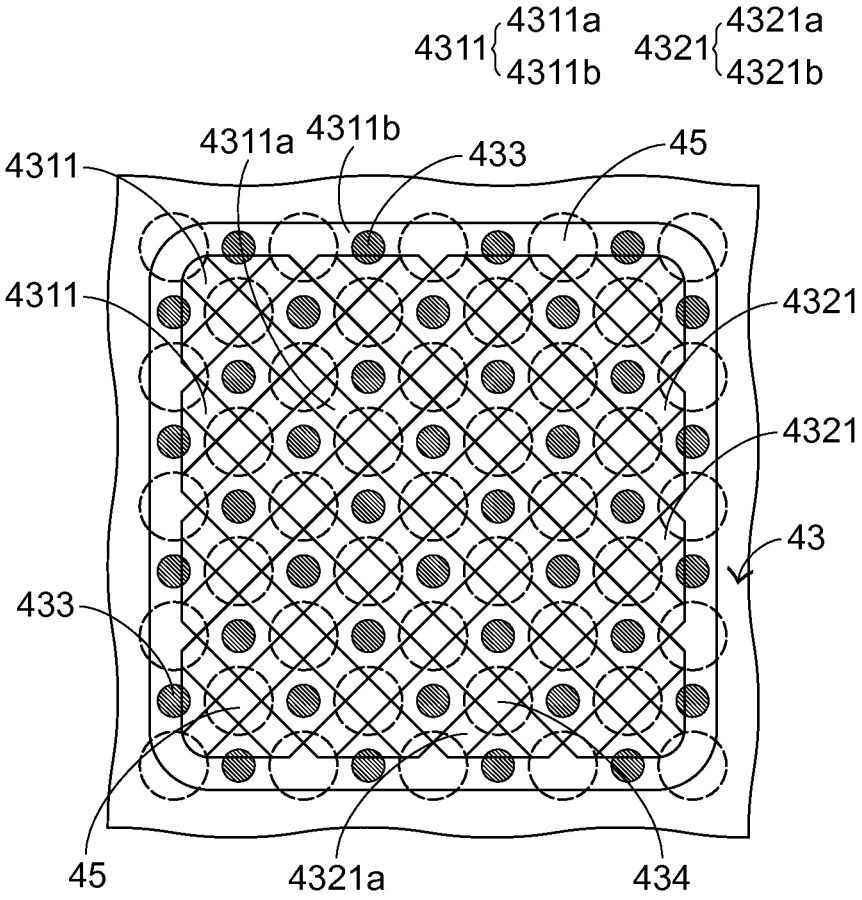
FIG. 9 is a schematic assembled view illustrating a portion of the switch circuit board of FIG. 8.

The present invention further provides a switch circuit board of a keyboard module according to a second embodiment of the present invention. FIG. 8 is a schematic exploded view illustrating a switch circuit board of a keyboard module according to a second embodiment of the present invention. FIG. 9 is a schematic assembled view illustrating a portion of the switch circuit board of FIG. 8. As shown in FIGS. 8 and 9, the switch circuit board 43 comprises an upper wiring plate 431, a lower wiring plate 432, plural spacing dots 433 and plural key intersections 434. The upper wiring plate 431 comprises plural first wiring patterns 4311. Each of the first wiring patterns 4311 comprises plural first inner wiring parts 4311*a* and a first outer wiring part 4311*b* around the plural first inner wiring parts 4311*a*. The lower wiring plate 432 is disposed under the upper wiring plate 431. Similarly, the lower wiring plate 432 comprises plural second wiring patterns 4321. Each of the second wiring patterns 4321 comprises plural second inner wiring parts 4321*a* and a second outer wiring part 4321*b* around the plural second inner wiring parts 4321*a*. The plural first inner wiring parts 4311*a* are arranged along a left-oblique direction D3, and the plural second inner wiring parts 4321*a* are arranged along a right-oblique direction D4. Each first wiring pattern 4311 and the corresponding second wiring pattern 4321 are aligned with the corresponding key part of the pressing layer (not shown).

The plural spacing dots 433 are arranged between the upper wiring plate 431 and the lower wiring plate 432. The upper wiring plate 431 and the lower wiring plate 432 are separated from each other by the plural spacing dots 433. The overlap regions between the first inner wiring parts 4311*a* of the first wiring patterns 4311 and the second inner wiring parts 4321*a* of the second wiring patterns 4321 are formed as the corresponding key intersections 434. Moreover, the plural glue dots 45 are aligned with the corresponding key intersections 434.

The keyboard module of this embodiment is distinguished from the keyboard module of the above embodiment by the following two aspects. Firstly, in this embodiment, the plural spacing dots 433 are disposed on a bottom surface 4312 of the upper wiring plate 431. Moreover, some of the plural spacing dots 433 are stacked on a portion of the first wiring pattern 4311. In particular, some of the spacing dots 433 are disposed on the first wiring pattern 4311, and the other spacing dots 433 are disposed on the upper wiring plate 431 without the first wiring pattern 4311. Secondly, as shown in FIG. 8, every two adjacent first inner wiring parts 4311*a* are separated from each other by a first gap g3, and every two adjacent second inner wiring parts 4321*a* are separated from each other by a second gap g4. The widths of the first gaps g3 are identical. The widths of the second gaps g4 are identical. More preferable, the width of the first gap g3 and the width of the second gap g4 are identical. Since the plural first inner wiring parts 4311*a* are arranged along the left-oblique direction D3 and the plural second inner wiring parts 4321*a* are arranged along the right-oblique direction D4, the plural key intersections 434 can be uniformly distributed in the coverage range of the corresponding key part. Consequently, the hand feel of pressing the key part will be enhanced.

From the above descriptions, the present invention provides the keyboard module. The switch circuit board comprises plural key intersections and plural spacing dots corresponding to the pressing layer. Consequently, when any position of the key part is pressed by the user's finger, the corresponding key signal can be effectively generated. That is, for generating the key signal, the pressed position of the key part is not restricted to the middle region thereof. In the keyboard module of the present invention, the plural bonding zones of the lower wiring plate are used as the support points fixed on the base plate. When the key part is pressed, both of the upper wiring plate and the lower wiring plate are bent. Consequently, it is assured that the first wiring pattern and the corresponding second wiring pattern can be electrically contacted with each other. That is, when the key part is pressed, the key signal can be correspondingly generated and the problem of causing erroneous action is overcome.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keyboard module, comprising:

a pressing layer comprising plural key parts, wherein the plural key parts are exposed to a top surface of the keyboard module;

a switch circuit board disposed under the pressing layer, wherein when the switch circuit board is triggered by one of the plural key parts, a corresponding key signal is generated, wherein the switch circuit board comprises plural key intersections and plural spacing dots;

a base plate connected with the switch circuit board, wherein the pressing layer and the switch circuit board are supported on the base plate; and plural glue dots arranged between the base plate and the switch circuit board, wherein the base plate and the switch circuit board are combined together through the plural glue dots, wherein the plural glue dots and the plural spacing dots are staggered.

2. The keyboard module according to claim 1, wherein the switch circuit board further comprises:

an upper wiring plate comprising plural first wiring patterns, wherein each of the plural first wiring patterns comprises a first outer wiring part and plural first inner wiring parts; and a lower wiring plate disposed under the upper wiring plate, and comprising plural second wiring patterns, wherein each of the plural second wiring patterns comprises a second outer wiring part and plural second inner wiring parts, wherein the plural key intersections are defined by the plural first inner wiring parts and the plural second inner wiring parts collaboratively, wherein the plural spacing dots are arranged between the upper wiring plate and the lower wiring plate, and the upper wiring plate and the lower wiring plate are separated from each other by the plural spacing dots, wherein the plural spacing dots and the plural key intersections are staggered.

3. The keyboard module according to claim 2, wherein a bottom surface of the lower wiring plate comprises:

plural bonding zones, wherein the plural glue dots are disposed on the corresponding bonding zones, and the lower wiring plate is fixed on the base plate through the plural glue dots on the bonding zones; and plural non-bonding zones, wherein no glue dots are disposed on the lower wiring plate corresponding to the plural non-bonding zones, wherein when the corresponding key part is pressed, the non-bonding zones corresponding to the pressed key part is moved, so that the lower wiring plate corresponding to the non-bonding zones is bent.

4. The keyboard module according to claim 3, wherein the plural key intersections are aligned with at least portions of the plural glue dots.

5. The keyboard module according to claim 3, wherein the plural spacing dots are disposed on a top surface of the lower wiring plate corresponding to the non-bonding zones.

6. The keyboard module according to claim 2, wherein a first gap between every two adjacent first inner wiring parts has the same width, and a second gap between every two adjacent first inner wiring parts has the same width.

7. The keyboard module according to claim 2, wherein the upper wiring plate and the lower wiring plate are made of polyethylene terephthalate (PET), polyurethane (PU), polyimide (PI) or polypropylene (PP), wherein the plural spacing dots are formed on a top surface of the lower wiring plate or a bottom surface of the upper wiring plate by a printing process, a spraying process, a transfer printing process or a coating process.

8. The keyboard module according to claim 2, wherein portions of the plural spacing dots are disposed on the second wiring patterns or the first wiring patterns, and the other portions of the plural spacing dots are disposed on the lower wiring plate or the upper wiring plate without the second wiring patterns or the first wiring patterns.

9. The keyboard module according to claim 2, wherein the plural spacing dots are disposed on the second wiring patterns or the first wiring patterns.

10. The keyboard module according to claim 1, wherein the pressing layer is made of polyurethane, and the base plate is made of fiberglass reinforced epoxy resin.

* * * * *